US005139095A

United States Patent [19]

Lyon et al.

[11] Patent Number: 5,139,095

[45] Date of Patent: Aug. 18, 1992

[54] METHOD FOR REMOVING DEBRIS FROM A DRILLHOLE

[75] Inventors: Leland H. Lyon; Ernest C. Hinck, both of Roanoke, Va.

[73] Assignee: Ingersoll-Rand Company, Woodcliff Lake, N.J.

[21] Appl. No.: 766,867

[22] Filed: Sep. 27, 1991

[51] Int. Cl.[5] ..... C09K 7/00

[52] U.S. Cl. ..... 175/68; 175/69; 175/296; 175/100; 175/324

[58] Field of Search ..... 175/58, 65, 68, 107, 175/69, 213, 232, 234, 242, 300, 308, 309, 296

[56] References Cited

U.S. PATENT DOCUMENTS

| | | | |
|---|---|---|---|
| 2,329,745 | 9/1943 | Crook | 175/337 |
| 2,819,038 | 1/1958 | Eckel | 175/308 |
| 2,920,872 | 1/1960 | Baur et al. | 175/205 |
| 2,937,619 | 5/1960 | Kurt . | |
| 2,950,087 | 8/1960 | Gregory | 175/205 |
| 3,094,175 | 1/1963 | Jackson | 175/205 |
| 3,102,600 | 9/1963 | Jackson | 175/308 |
| 3,118,510 | 1/1964 | Kanady et al. | 175/308 |
| 3,198,267 | 8/1965 | Madson | 175/205 |
| 3,730,592 | 5/1973 | Wenneborg et al. | 175/213 X |
| 3,735,824 | 5/1973 | Astrom | 175/213 |
| 3,788,408 | 1/1974 | Dysart | 175/337 |
| 3,790,213 | 2/1974 | Grable | 175/58 X |
| 4,084,646 | 4/1978 | Kurt | 173/17 |
| 4,245,710 | 1/1981 | Dolezal et al. | 175/337 |
| 4,421,182 | 12/1983 | Moody et al. | 175/65 |
| 4,515,229 | 5/1985 | Drummond et al. | 175/69 X |
| 4,688,650 | 8/1987 | Hayatdavoudi et al. | 175/324 |

*Primary Examiner*—Ramon S. Britts
*Assistant Examiner*—Roger J. Schoeppel
*Attorney, Agent, or Firm*—John J. Selko

[57] ABSTRACT

A method for removing debris from a drillhole, includes positioning a separator adjacent to a down-the-hole percussive drillhead, for removing water and other matter from the percussive fluid prior to the percussive fluid entering the drillhead. The water and other matter are ejected into the drillhole to remove the debris, and backflow of debris and water into the separator and drillhead is prevented, during periods when the percussive fluid flow ceases.

11 Claims, 4 Drawing Sheets

METHOD FOR REMOVING DEBRIS FROM A DRILLHOLE

BACKGROUND OF THE INVENTION

This invention relates generally to rock drills and more particularly to pneumatically operated percussive drills of the type adapted to be inserted into the drillhole being drilled thereby and commonly known as "down-the-hole" drills or (DHD).

Many applications for down-the-hole drills require that fluids such as water and other matter be injected into the drill air supply to provide improved hole cleaning and stabilization. Typically, the volume of liquids injected can range from about 2.0 gallons per minute to about 15.0 gallons per minute. When water is injected into the air flow for a DHD, an appreciable loss in penetration rate results for a given pressure. The decrease in penetration rate can range from 30% to 60%, depending upon the fluid injection rate and pressure. The loss in hammer performance associated with fluid injection adversely affects DHD production and in many cases causes the use of DHD to be unsuitable.

The foregoing illustrates limitations known to exist in present down-the-hole drilling technology. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a method for removing debris from a drillhole including positioning a separator adjacent a top end of a percussion drilling tool for receiving a flow of a mixture of percussive fluid and other matter from a drill string axial bore; removing and collecting substantially all of the other matter from the percussive fluid and thereafter transmitting the percussive fluid through the separator to the tool, while simultaneously transmitting the collected other matter and at least some of the percussive fluid out of the separator into the drillhole annulus, for removing debris; while also simultaneously sealing the separator against backflow of debris into the separator, when flow of percussive fluid ceases.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
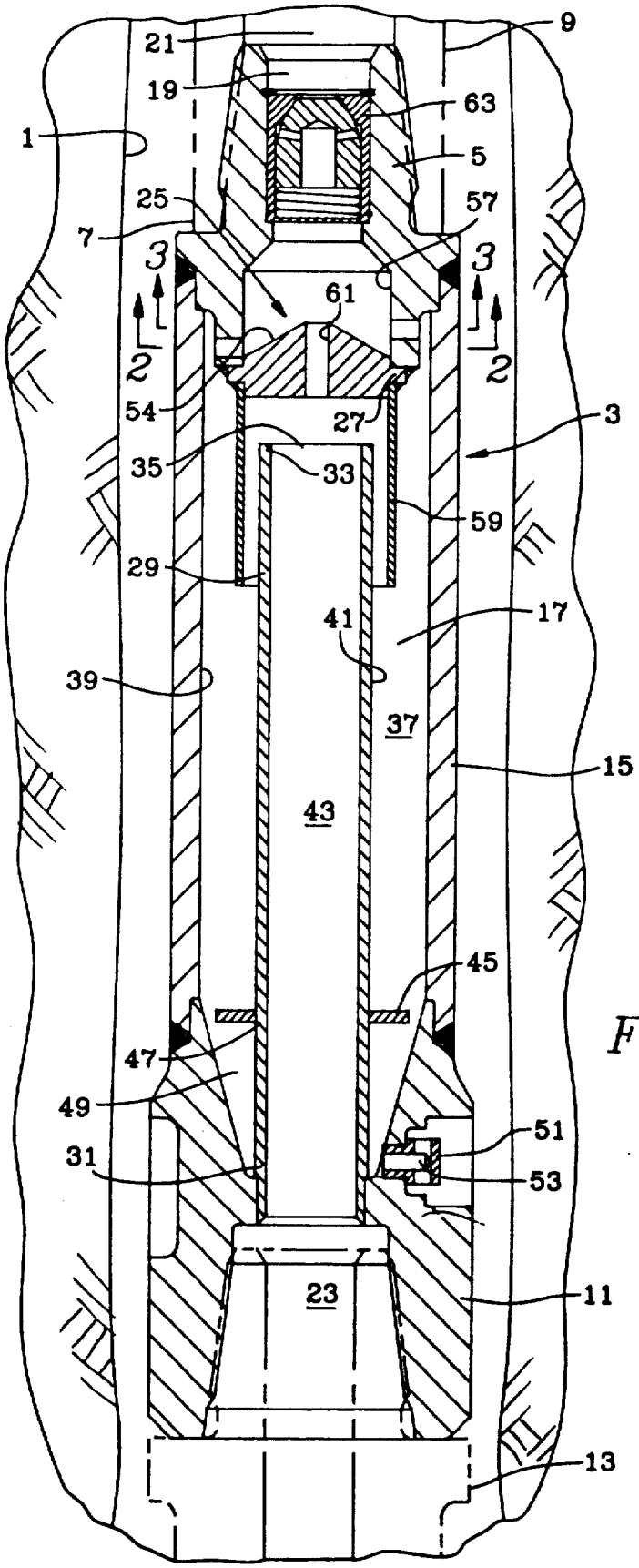
FIG. 1 is longitudinal section of a cleaning device for use with a fluid-activated, percussion, down-the-hole drill tool, suitable for use in this invention.

Referring to FIG. 1 there is shown a drillhole 1, having a drillhole cleaning device suitable for use in the method of this invention, shown generally as 3, positioned therein. Cleaning device 3 has a top connector 5 connected by conventional means, such as threads, to the bottom end 7 of a drill string 9. A bottom connector 11 connects device 3, by conventional means, such as threads, to the back head of a down-the-hole drill 13. Equivalently, bottom connector 11 could connect to another member in a drillstring 9, rather than drill 13, so long as device 3 is within the drillhole 1 and adjacent to drill 13.

As is well known, a fluid is caused to flow through drill string 9 to activate drill 13. In this instance, drill 13 is of the type known as a percussive down-the-hole drill activated by a pneumatic fluid, such as air. Eventually, the fluid exits the drill head and moves up the drillhole to carry out debris from drilling. Debris from drilling can include particles of strata being drilled, water seeping into the drillhole, plus other matter introduced into the drill 13 via the drillstring 9.

In order to increase debris removal, water may be injected into the fluid. Other matter, such as oil, may be injected for lubrication of the tool head. In addition, other matter, such as particles of rust or scale dislodged from the drill string interior may be carried by the fluid. Thus, the percussive fluid may be a mixture of air, water, oil, and other matter, including solid particles.

As used herein, the term "percussive" refers to the type of drill that utilizes a reciprocating piston to impart impact forces to a drill head to cause penetration of the strata, and does not refer to a rotary type drill that utilizes a rotary grinding action to cause penetration.

Also, as used herein, the term "percussive fluid" refers to the pneumatic fluid that imparts the reciprocating action to the drill piston.

A longitudinal casing 15 is fastened, as by welding, to top connector 5 and bottom connector 11, and defines a hollow vortex chamber 17 extending axially therebetween. A first inlet 19 at top connector 5 fluidly communicates axially between drill string axial bore 21 and vortex chamber 17. A first outlet 23 at bottom connector 11 fluidly communicates axially between vortex chamber 17 and backhead 13.

Figure 2:
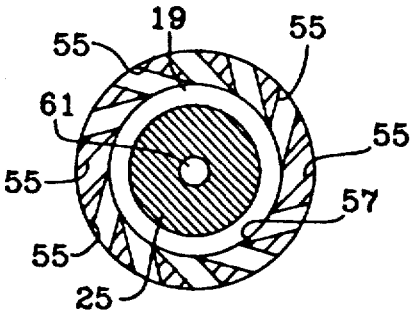
FIG. 2 is a horizontal cross sectional view taken along lines 2—2 of FIG. 1.
Figure 3:
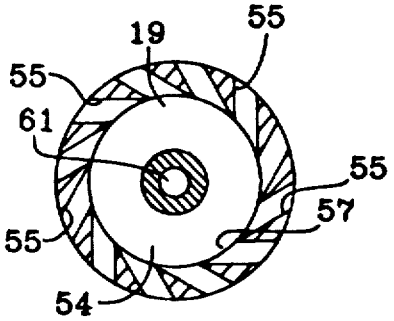
FIG. 3 is a horizontal cross sectional view taken along lines 3—3 of FIG. 1.

A deflector means, shown generally as 25, is sealingly fastened in first inlet 19. As shown in FIGS. 2 and 3, in horizontal cross section, inlet 19 is circular in outline, as is deflector means 25, although other shapes of outline could be used. Referring again to FIG. 1, deflector means 25 further comprises a deflector plate 27 extending across first inlet 19, in a plane that is transverse to, and perpendicular to, the longitudinal axial direction of vortex chamber 17 and bore 21. This plane of deflector plate 27 is referred to herein as a "radial" plane or direction. Deflector means 25 deflects flow of a mixture percussive fluid and other matter from a downward axial direction to a radial and tangential direction, as hereinafter described.

A hollow focus tube 29 below deflector means 25 extends axially through vortex chamber 17 and has a lower end 31 sealingly in contact with bottom connector 11, and an upper end 33 terminating adjacent deflector means 25 in a focus tube inlet 35. Focus tube 29 defines a first percussive fluid passageway 37 between inner surface 39 of casing 15 and outer surface 41 of focus tube 29. Focus tube 29 also defines a second percussive fluid passageway 43 within focus tube 29 communicating axially between vortex chamber 17 and first outlet 23.

A baffle 45 is connected to the lower end 47 of focus tube 29 and extends annularly inwardly into first percussive fluid passageway 37 and ends spaced from inner surface 39, to cause reversal of flow of percussive fluid as described hereinafter.

A collection gallery 49 is formed below baffle 45 in lower end 47 of vortex chamber 17, for collecting other matter separated from the percussive fluid, as hereinafter described. A collection gallery outlet 51 communicates between the drillhole bore and the inside of collection gallery 49 to permit flow of other matter collected therein, plus some of the percussive fluid out into the annulus of the borehole 1. Outlet 51 can be a simple "T" shaped nipple having open passageways 53 therethrough. Although one outlet 51 is shown, a plurality of outlets, spaced circumferentially around vortex chamber 17 may be used.

Referring now to deflector means 25, deflector plate 27 has a cone shaped upper surface 54 extending axially upwardly within first inlet 19. As shown in FIGS. 2 and 3, connector 5 has a plurality of apertures 55 therethrough. Apertures 55 extend in a radial direction with respect to the axial direction of chamber 17. Inlet 19, is circular in outline as viewed in horizontal cross section, and apertures 55 extend tangentially with respect to the inner surface 57 of inlet 19. Apertures 55 communicate fluidly between first inlet 19 and first fluid passageway 37. Sealingly suspended downwardly from plate 27 is a hollow shield tube 59 telescoped axially over focus tube inlet 35, and extending a sufficient distance to prevent entry of the percussive fluid mixture into focus tube inlet 35 until after the percussive fluid mixture has passed downwardly the length of vortex chamber 17 and reversed direction at baffle 45. A single aperture 61 extends axially downwardly through plate 27 to form a passageway communicating between first inlet 19 and focus tube inlet 35 to permit at least some of the percussive fluid mixture to by-pass the deflector means, so as to permit as small amount of percussive fluid mixture to flow directly to the drill tool head for a purpose such as lubrication. It would be equivalent to provide a plurality of apertures instead of single aperture 61.

Sealingly positioned in first inlet 19 is a one-way flow valve 63 adapted for permitting only downward axial flow of the percussive fluid mixture therethrough. During flow of percussive fluid, valve 63 is normally open. When flow of percussive fluid ceases, valve 63 closes. The need for valve 63 is because water and other debris from the borehole annulus backflows into the collection chamber 49 via open passageways 53, when fluid flow ceases. Such backflow accumulates in chamber 17, and would rise up to the focus tube inlet 35 and thence flow into the drill tool, to cause damage to the drill when it starts operation again. This feature is important because, during periods when the operators are not working, the drill is left down in the drillhole.

Figure 4:
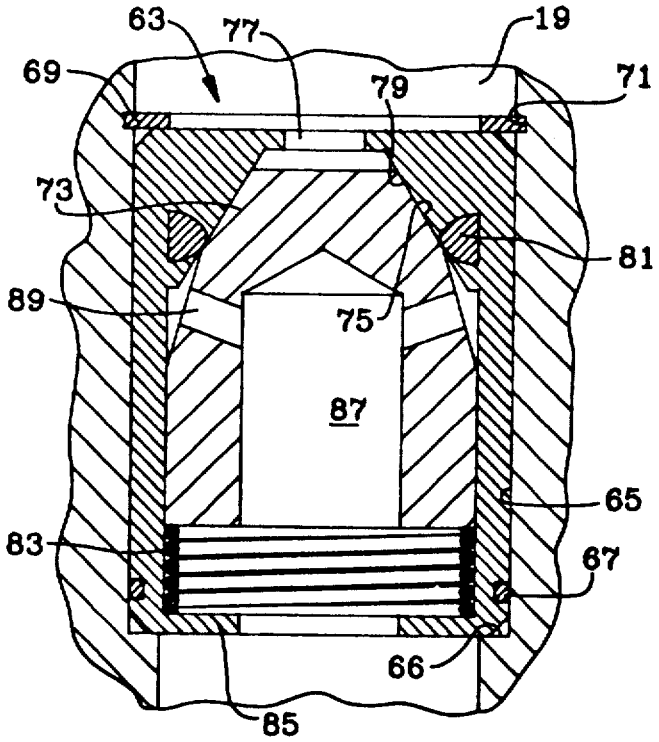
FIG. 4 is a longitudinal section of a one-way valve suitable for the invention, with portions removed.

With valve 63 closed, percussive fluid is trapped inside cleaning device 3, and as water and debris rise inside vortex chamber 17, the percussive fluid becomes compressed until its pressure equals the backflow pressure, and backflow ceases. Any conventional one-way valve will suffice. FIG. 4 shows one embodiment of such valve.

Referring to FIG. 4, one-way valve 63 includes a hollow tubular body 65, removably positioned on shoulder 66 in first inlet 19. Annular elastic seal 67 positioned in a groove in outer surface of body 65 sealingly contacts inner surface 57 of inlet 19. Body 65 is retained in place by retainer ring 69 positioned in matching groove 71, as is well known. Slidably positioned within hollow body 65 is hollow valve stem 73. Valve stem 73 has a truncated conical upper end 75 extending axially upwardly toward axial inlet aperture 77 in body 65. Body 65 has seal seat 79 sloped downwardly therein, shaped to conform to conical upper end 75. Positioned in seat surface 79 is elastic seal means 81 for alternate sealing and unsealing against upper end 75, as described hereinafter. Annular elastic spring means 83 seated against bottom flange 85 of body 65 contacts bottom end of stem 73, and urges stem 73 upwardly, so as to cause upper end 75 to sealingly contact seat surface 79 and seal 81. Thus, valve 63 is normally closed to percussive fluid flow. Inside stem 73 is hollow inlet chamber 87 that communicates axially with vortex chamber 17. A plurality of fluid passageways 89 extend through the wall of stem 73. Passageways 89 are spaced around the perimeter of conical surface 75. In operation, percussive fluid acts upon upper surface 75 to cause stem 73 to move axially downwardly and lose sealing contact with seal 81, thereby opening up a fluid passageway between axial bore 21, inlet 77 and inlet chamber 87, via passageways 89. When percussive fluid pressure is zero, as when the drill is inoperative, spring 83 urges stem 73 into sealing engagement with seat 79, thereby closing valve 63. The elastic property of spring 83 is preferably selected so that with a residual percussive fluid pressure greater that zero, and equal to, but not greater than the pressure inside vortex chamber 17, with an inoperative drill, the valve will remain closed.

An acceptable alternative would be to position a one-way valve at outlet 51 instead of within inlet 19.

In operation, the mixture of percussive fluid and other matter flows axially downwardly into first inlet 19, against upper surface 54 and is deflected to a tangential and radial outward direction into vortex chamber 17, to impact tangentially against inner surface 39 of casing 15. Thereafter, the percussive fluid mixture flows downwardly and circularly, in a vortex fashion, through first percussive fluid passageway 37 of vortex chamber 17, causing separation of at least some of the other matter from the percussive fluid mixture Such separated matter flows downward along inner surface 39 of casing 15 to collection chamber 49. At the lower end of chamber 17, the percussive fluid mixture strikes baffle 45, reverses its flow to an upward direction, causing separation of more of the other matter from percussive fluid mixture, and collection thereof in collection gallery 49. The percussive fluid, with substantially all of the other matter now removed, flows upwardly along the outer surface 41 of focus tube 29 toward focus tube inlet 35; thereafter down second fluid passageway 43, through outlet 23, into the backhead 13 of the drill tool, and thence therethrough to the drillhole bore, as is conventional.

The method of this invention was tested using a down-the-hole drill sold by Ingersoll-Rand Company under the product identification of DHD 380M, using an 8/58 inch diameter, cone-faced, button bit. A series of test holes were drilled in a block of barre granite, using various combinations of water injection rate, percussive fluid pressure and percussive fluid flow rates, with the results as discussed hereinafter.

TEST 1

Figure 5:
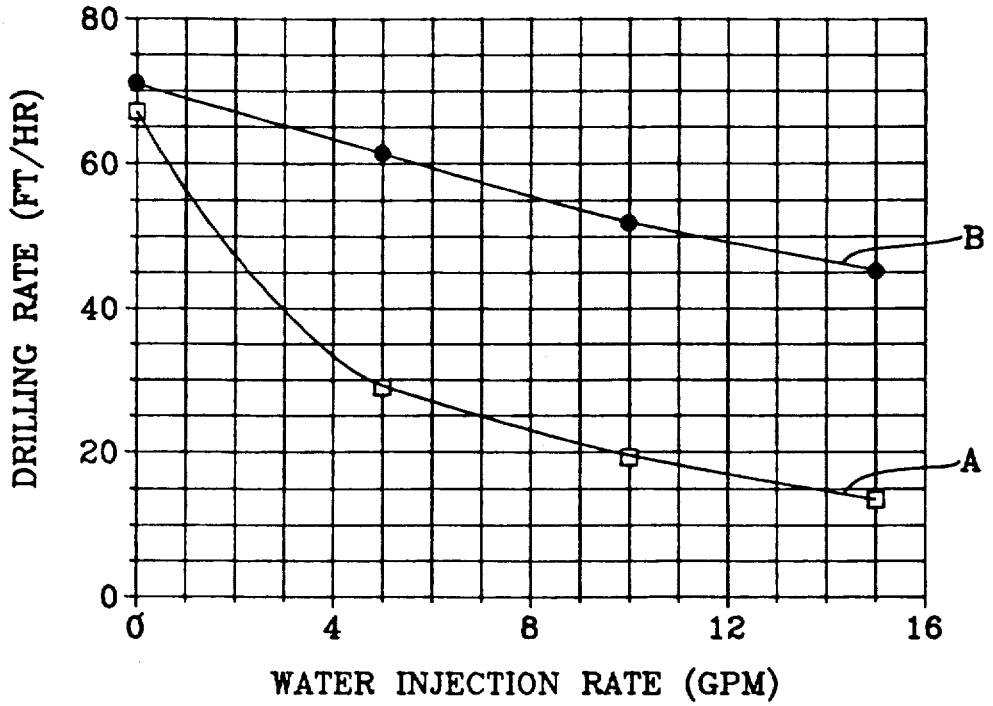
FIG. 5 is a graph of performance showing the improved penetration rates for various water injection rates, achieved with the subject invention.

FIG. 5 shows the rate of penetration in feet per hour (FT/HR) of the drill head for various rates of water injection, in gallons per minute (GPM), with and without the method of this invention. The test was performed at a fixed percussive fluid pressure of 200 pounds per square inch (PSI). Curve A shows the results without following the method of this invention. As the water injection rate increases, the rate of penetration falls off very quickly. Curve B shows the results with the method of this invention.

With the method of this invention applied, the rate of penetration remains much higher than without the invention. For example, at 5 GPM, the rate of penetration with the invention is about 61 FPM, as compared to about 29 FPM without the invention. At 10 GPM the rates of penetration with and without the invention are about 55 FPM and 20 FPM, respectively. Likewise, at 15 GPM, the respective rates of penetration are about 45 FPM and 16 FPM.

TEST 2

Figure 6:
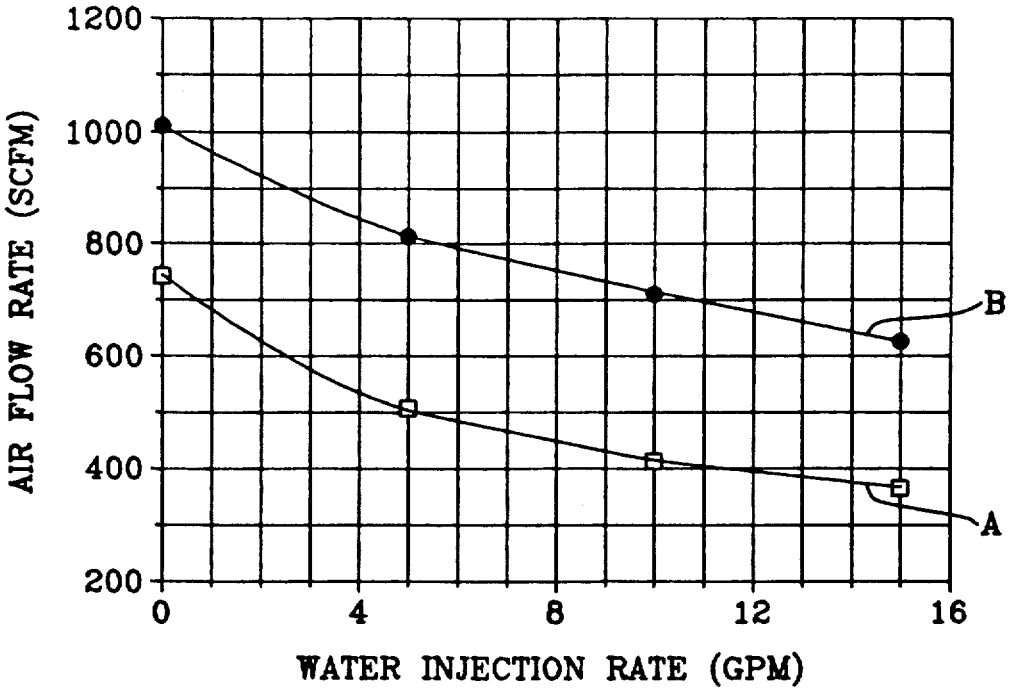
FIG. 6 is a graph of performance showing the improved percussive fluid flow rates for various water injection rates, achieved with the subject invention.

FIG. 6 shows the percussive fluid flow rate in standard cubic feet per minute (SCFM) for various rates of water injection, in gallons per minute (GPM), with and without the method of this invention. The test was performed at a fixed percussive fluid pressure of 200 pounds per square inch (PSI). Curve A shows the results without following the method of this invention. As the water injection rate increases, the percussive fluid flow rate falls off. Curve B shows the results with the method of this invention.

With the method of this invention applied, percussive fluid flow rate remains much higher at all rates of water GPM, the percussive fluid flow rate with the invention is about 800 SCFM, as compared to about 500 SCFM without the invention. At 10 GPM the percussive fluid flow rates with and without the invention are about 700 SCFM and 400, respectively. Likewise, at 15 GPM, the respective percussive fluid flow rates are about 650 SCFM and 375 SCFM. Even at a water injection rate of 0, the method of this invention allowed an increased percussive fluid flow rate to be used, for the same settings on the percussive fluid compression system. The ability to increase the percussive fluid flow rate over all rates of water injection is important to the operator because it allows the operator to achieve increased debris removal.

TEST 3

Figure 7:
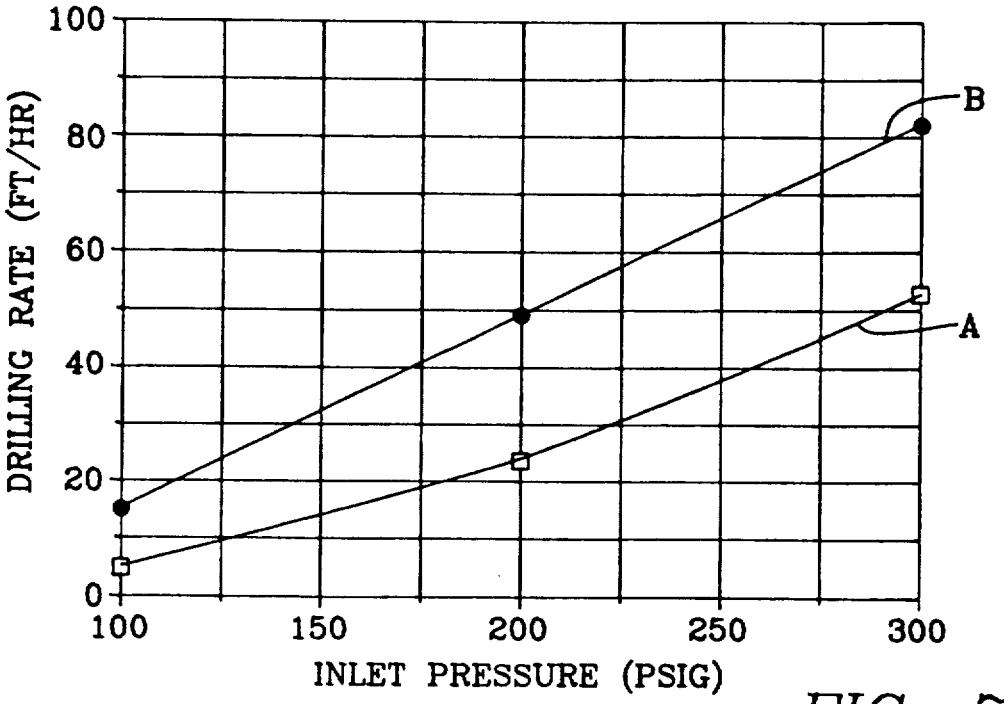
FIG. 7 is a graph of performance showing the improved penetration rates for various percussive fluid pressures, achieved with the subject invention.

FIG. 7 shows the rate of penetration (FT/HR) for various pressures of percussive fluid in pounds per square inch (PSI), with and without the method of this invention. The test was performed at a fixed water injection rate of 10 GPM. Curve A shows the results without following the method of this invention. Curve B shows the results with the method of this invention.

With the method of this invention applied, the rate of penetration remains much higher at all pressures of percussive fluid than without the invention. For example, at 100 PSI, the rate of penetration with the invention is about 15 FPM, as compared to about 5 FPM without the invention. At 200 PSI, the rates of penetration with and without the invention are about 50 FPM and 25 FPM, respectively. Likewise, at 300 PSI, the rates of penetration are about 85 FPM and 45 FPM, respectively.

TEST 4

Figure 8:
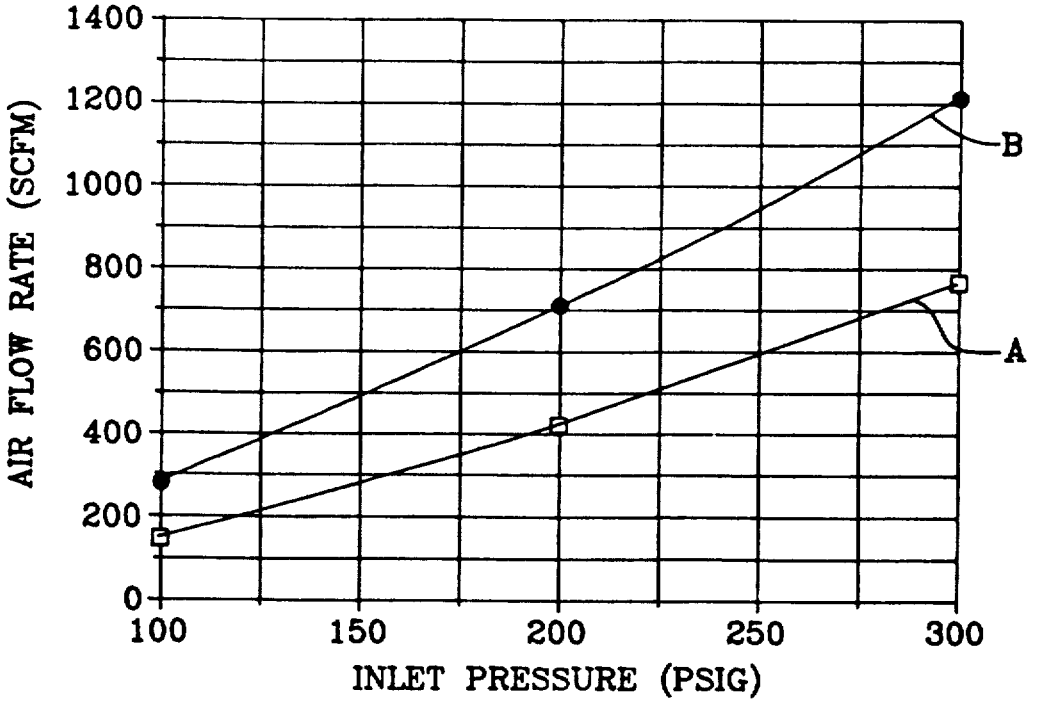
FIG. 8 is a graph of performance showing the improved percussive fluid flow rates for various fluid pressures, achieved with the subject invention.

FIG. 8 shows the percussive fluid flow rate (SCFM) for various pressures of percussive fluid in pounds per square inch (PSI), with and without the method of this invention. The test was performed at a fixed water injection rate of 10 GPM. Curve A shows the results without following the method of this invention. Curve B shows the results with the method of this invention.

With the method of this invention applied, the percussive fluid flow rate remains much higher at all pressures of percussive fluid than without the invention. For example, at 100 PSI, the percussive fluid flow rate with the invention is about 200 SCFM, as compared to about 150 SCFM without the invention. At 200 PSI, the percussive fluid flow rates are about 700 SCFM and 400 SCFM, respectively. Likewise, at 300 PSI, the percussive fluid flow rates are about 1200 SCFM and 800 SCFM respectively.

While this invention has been illustrated and described in accordance with a preferred embodiment, it is recognized that other variations and changes may be made therein without departing from the invention as set forth in the claims.

Having described the invention, what is claimed is:

1. A method for removing debris from a drillhole, said drillhole being made by a fluid-activated, percussion, down-the-hole drill tool, said tool adapted to be suspended at its top end from a drill string having an axial bore, comprising:

a) positioning a separator device between said top end of said drill tool and a bottom end of said drill string;

b) injecting into said bore a flow of a mixture of a gaseous percussive fluid and other matter;

c) transmitting said mixture down into said separator in said drillhole;

d) removing substantially all of said other matter from said mixture as a separate phase prior to said percussive fluid entering said drill tool;

e) simultaneously ejecting said removed other matter from said separator into said drillhole, to remove said debris; and f) simultaneously preventing backflow of said debris from said drillhole into said separator, when said flow of said mixture ceases.

2. The invention of claim 1 in which said percussive fluid is air.

3. The invention of claim 2 in which said other matter is substantially all water;

4. The invention of claim 2 in which said other matter is a mixture of solid particles from the axial bore of said drill string and water.

5. The invention of claim 2 in which said other matter is a mixture of solid particles from the axial bore of said drill string, oil and water.

6. The invention of claim 3 in which said water is injected at the rate of between 0 and 15 gallons per minute.

7. The invention of claim 6 in which the air flow rate is between 200 and 1100 standard cubic feet per minute.

8. The invention of claim 7 in which the air pressure is between 100 and 300 pounds per square inch.

9. The invention of claim 8 in which the air flow rate is between 600 and 1000 standard cubic feet per minute.

10. The invention of claim 5 which includes the further step of simultaneously injecting into said drill tool at least some of said percussive fluid mixture prior to removal of said other matter, to lubricate said drill tool.

11. A method for removing debris from a drillhole, said drillhole being made by a fluid-activated, percussion, down-the-hole drill tool, said tool adapted to be suspended at its top end from a drill string having an axial bore, comprising:

a) positioning a separator device between said top end of said drill tool and a bottom end of said drill string;

b) injecting into said bore a flow of a mixture of air and water;

c) transmitting said mixture down into said separator in said drillhole;

d) removing substantially all of said water from said mixture prior to said air entering said drill tool;

e) simultaneously ejecting said removed water from said separator into said drillhole, to remove said debris;

f) simultaneously preventing backflow of said debris from said drillhole into said separator, when said flow of said air ceases; and g) simultaneously injecting into said drill tool at least some of said air and water mixture prior to removal of said water, to lubricate said drill tool.

* * * * *